United States Patent [19]

Williams

[11] 4,371,161

[45] Feb. 1, 1983

[54] ANKLE AND FOOT EXERCISE APPARATUS

[76] Inventor: Victor N. Williams, 2913 Peregoy Dr., Kensington, Md. 20795

[21] Appl. No.: 260,791

[22] Filed: May 5, 1981

[51] Int. Cl.[3] ..... A63B 23/00

[52] U.S. Cl. ..... 272/96; 272/142

[58] Field of Search ..... 272/96, 143, 142, 137, 272/93, 70; 128/80 R, 80 DB, 25 B

[56] References Cited

U.S. PATENT DOCUMENTS

| | | | |
|---|---|---|---|
| 539,872 | 5/1895 | Gkeiralla | 272/70 |
| 1,509,793 | 9/1924 | Thompson | 272/96 X |
| 2,467,943 | 4/1949 | Mikell | 272/137 |
| 2,966,905 | 1/1961 | Kamenshine | 128/80 R X |
| 4,206,558 | 6/1980 | Bivona | 272/70 X |
| 4,310,154 | 1/1982 | Kauffman | 272/142 X |

*Primary Examiner*—George J. Marlo

*Attorney, Agent, or Firm*—Nicholas J. Cafarelli

[57] ABSTRACT

An ankle and foot exercise apparatus, in which a structure attached to the lower leg is a base plate having side supports that are attached to a rotatable support arm that is connected to one end of an elastic member, the other end of the elastic member being attached to a strap that encircles the ball of the foot. This elastic member, such as a surgical hose, causes a resistance to foot movement and ankle rotation, and thus the foot and ankle are exercised by moving those body parts against the resistance provided by the surgical hose. The attachment of this exerciser is facilitated by rotating the support arm relative to the side supports about a first bolt that is inserted and locked through a first set of aligned holes in support arm and in the side supports attaching the surgical hose to a rotatable support arm on the base plate. When the rotatable arm is rotated to a down position, this causes a slack in the surgical hose during attachment. When the exerciser is attached, the rotatable support arm is raised and locked by a second bolt inserted and locked through a second set of aligned holes in the support arms and the side supports in the raised position, stressing the surgical hose to its exercise position.

4 Claims, 5 Drawing Figures

ANKLE AND FOOT EXERCISE APPARATUS

REFERENCES

Devices that could be used to exercise the ankle and foot are described in U.S. Pat. Nos. 1,509,793,—2,206,902,—2,035,549,—3,525,522 and 4,186,920. While those devices can serve a useful exercise function, all require a substantial and expensive movement resistant structure such as may be found in the exercise room of an athletic club. My invention differs from these reference devices in that, while it performs the same functions, it is considerably less expensive and when not in use is small enough to be packaged in a handbag.

BACKGROUND OF INVENTION

There has long been a need for an inexpensive and compact ankle exerciser, to strengthen the intrinsic and extrinsic muscles of the lower leg, ankle and foot. The intrinsic muscles, of which there are ten, are located within the foot on the plantar side. These muscles help to maintain structural strength in the arch and the tarsal and metatarsal alignment. These muscles also aid in plantar flexing the foot and the stabilization of the first big toe. Also they help to adduct and abduct the toes as well as the cupping action on the plantar side of the foot. The extrinsic muscles, of which there are also ten, originate in the lower leg pass the ankle joint by means of tendons which act like strong control cords and connect to bones within the foot. These muscle tendon cords perform a variety of functions that include dorsiflexion, plantar flexion, inversion, eversion, adduction and abduction. In addition they aid in cupping and rolling back of the toes, and in big toe stabilization and arch support.

The ankle joint itself is extremely strong yet very unstable. It is for this reason that most ankle sprains occur. In fact most sprains (85%) are of the lateral colateral type. Usually the foot is placing weight on an uneven object in the plantar position and suddenly inverts. By strengthening both areas of muscle in the lower leg and foot, one significantly reduces the possibility of ankle sprain and fracture.

This invention also has rehabilitation features that can aid in the recovery from a broken or sprained ankle. It will facilitate a progressive rehabilitation through a gradual strengthening program, by the use of progressively stronger surgical hoses to resist the exercise motives.

BRIEF DESCRIPTION OF INVENTION

The general object of this invention is to provide an ankle exerciser that enables the user to strengthen his ankle and foot muscles by voluntary foot motions that are partially restrained by the exerciser.

In accordance with this invention, this objective is achieved by attaching a structural member such as a base plate to the lower leg, attaching another structural member such as a strap to the ball region of the foot, and connecting these two structural members by a flexible member such as a surgical hose. This hose, which is available in various elasticity strengths, provides the resistance to the foot motions, and thus provides an inexpensive and self-contained mechanism for exercising and strengthening the ankle.

BRIEF DESCRIPTION OF THE DRAWINGS

A preferred embodiment of my invention is illustrated by the accompanying drawings, in which.

DESCRIPTION OF PREFERRED EMBODIMENT

This invention can best be understood by locating each part, in each of the figures in which that part is shown, when the part is first identified in the description.

Figure 1:
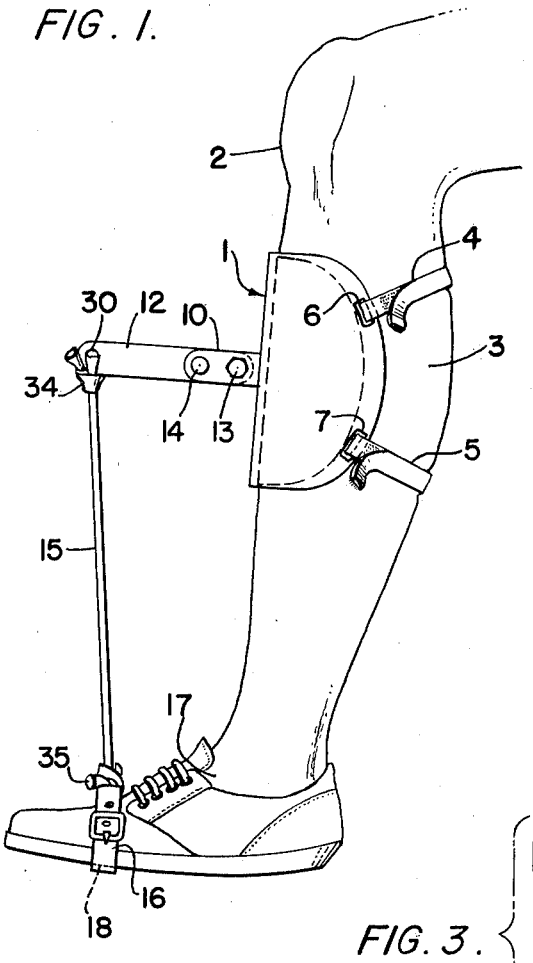
FIG. 1 shows a side view of the exerciser, connected to the lower leg and foot, in an operating position and ready to commence exercising.

Referring to FIG. 1, and to other figures identified in parentheses where appropriate, base plate 1 is shown strapped to leg 2 in the vicinity of calf 3 by straps 4 and 5. These straps 4 and 5 can be connected to base plate 1 in any manner that provides for tightening the base plate 1 snugly against leg 2, such that the base plate 1 will not slip, rotate, or otherwise move relative to leg 1 when the exerciser is in use. This objective can be achieved by straps 4 and 5, each having a nylon outer surface and a velcro inner surface 4*a* and 5*a*. One end of strap 4 is permanently affixed to base plate 1 by inserting its nylon outer surface through hole 6 in base plate 1. The short segment of strap 4 that is inserted through hole 6 is connected to the main segment of strap 4 by sewing, stapling, or other permanent connecting means. One end of strap 5 is permanently affixed to base plate 1 by inserting its nylon outer surface through hole 7 in base plate 1. The short short segment of strap 5 that is inserted through hole 7 is connected to the main segment of strap 5 by sewing, stapling, or other permanent connecting means. When baseplate 1 is positioned on leg 2, the loose ends of straps 4 and 5 are inserted through holes 8 and 9 respectively in base plate 1 and pulled tightly to prevent base plate 1 from slipping on leg 2. Each strap, when tightened, is folded back upon itself such that the velcro surfaces are in contact, thus preventing the strap from loosening. When straps 4 and 5 are tightened, this action pulls the outer member 19 of base plate 1 snugly against the leg 2, where in FIG. 2 it is shown in the flexed position by dash lines and in the snug position by solid lines. Inner member 20 of base plate 1 is made of rubber or an equivalent material such that there will not be an abrasive contact between baseplate 1 and leg 2.

Side supports 10 and 11 (see also FIG. 2) are permanently affixed to base plate 1, such as with glue, or these side supports may be formed as an integral part of the mold that forms base plate 1. Support arm 12, (shown in detail by FIG. 3) is connected to side supports 10 and 11 by bolt 13 and adjustable pin 14 (see also FIG. 2). Hole 30 is provided in support arm 12 in order that an elastic member such as surgical hose 15 can be tied with knot 34 to support arm 12. Nylon strap 16 is connected to foot 17 at ball 18. Surgical hose 15 is tied to, or otherwise firmly connected to leather strap 16 by knot 35.

Figure 2:
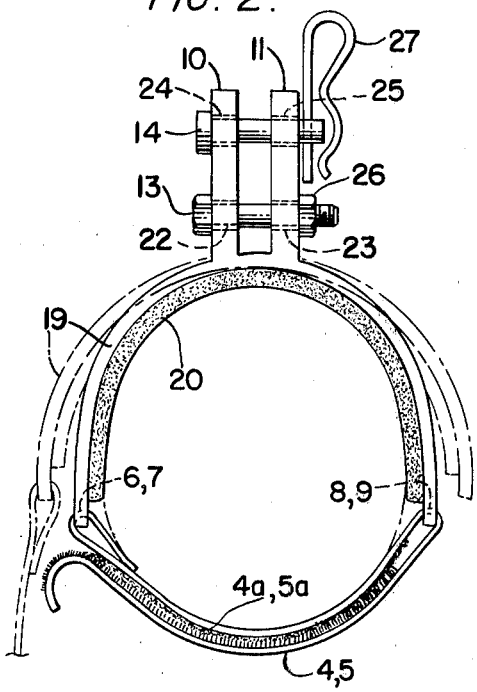
FIG. 2 shows a bottom view of the base plate that is strapped onto the lower leg.

Referring to FIG. 2, bolt 13 is shown inserted through holes 22 and 23 of side supports 10 and 11 respectively, and adjustable pin 14 is shown inserted through holes 24 and 25 of side supports 10 and 11 respectively. Lock nut 26 holds bolt 13 in place, and locking clip 27 holds adjustable pin 14 in place.

Figure 3:
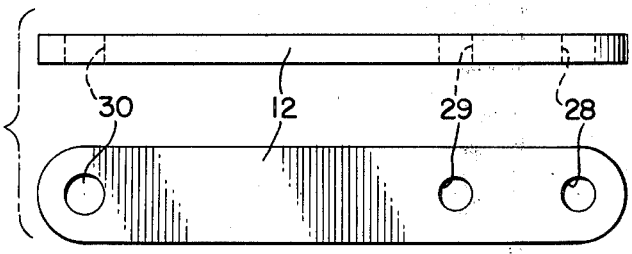
FIG. 3 shows top and side views of the support arm, that is attached to the base plate and provides the upper support connection for the surgical hose.

Referring to FIG. 3, the top and side views of support arm 12 show holes 28, 29 and 30. When the exerciser is assembled, support arm 12 is inserted between side supports 10 and 11, with bolt 13 passing through hole 28, adjustable pin 14 passing through hole 29, and surgical hose 15 is tied to hole 30.

Figure 4:
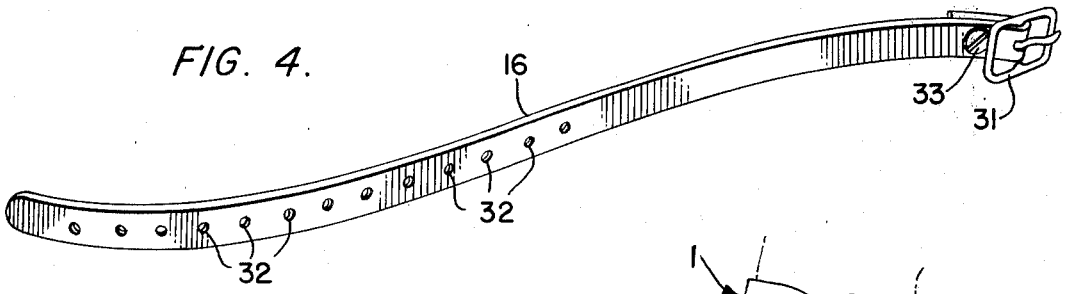
FIG. 4 shows a perspective view of the strap that is attached to the ball of the foot and provides the lower support connection for the surgical hose.

Referring to FIG. 4, leather strap 16, which is attached to the ball 18 of foot 17 (see FIG. 1), has a belt buckle 31 and buckle holes 32 to effect the strapping action. Screw rivet 33 holds belt buckle 31 onto leather strap 16. Surgical hose 15 is attached to leather strap 16 by knot 35.

Figure 5:
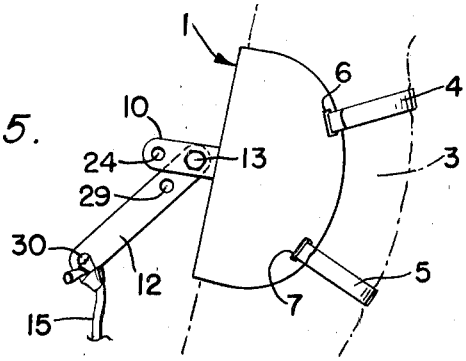
FIG. 5 shows the base plate attached to the leg, with its support arm in a loosened position to reduce the tensions in the surgical hose to enable the exerciser to be easily attached to the ball of the foot.

Referring to FIG. 5, support arm 12 is shown connected to side supports 10 and 11 (see also FIG. 2) by bolt 13 and nut 26, and thus allowed to pivot about bolt 13. When attaching the exerciser, support arm 12 is lowered below side supports 10 and 11 by pivoting it about bolt 13, such that there will be no tension in surgical hose 15 when base plate 1 is being connected to leg 2, and leather strap 16 is being connected to foot 17. When these two connections are made, then support arm 12 is raised to a position parallel to side supports 10 and 11, adjustable pin 14 is inserted through holes 24 and 25 of side supports 10 and 11 respectively and then hole 29 of support arm 12, and locked by locking clip 27, thus preparing the exerciser for operation.

Many possible embodiments may be made of this invention without departing from the scope thereof, and accordingly it is to be understood that all matters herein set forth or shown in the accompanying drawings are to be interpreted as illustrative and not in a limiting sense.

What is claimed is:

1. An ankle and foot exercise apparatus comprising: a rigid member adapted to be connected to the lower leg; a support arm connected to said rigid member; a flexible member adapted to be connected to the ball of the foot; an elastic member having a top end and a bottom end; connecting means for attaching the top end of said elastic member to said support arm; and connecting means for attaching the bottom end of said elastic member to said flexible member; wherein the said rigid member comprises a base plate formed to fit snugly over the leg shin bone; straps for attaching said base plate to said leg; two side supports permanently affixed to said base plate, with each side support having therein a first hole and a second hole, with said first hole being located closer to said base plate than said second hole; said support arm having a first hole and a second hole; and bolt and pin means for connecting said support arm to said side supports.

2. An ankle and foot exercise apparatus as described by claim 1, wherein the means for connecting said support arm to said side supports comprise:

aligning the first and second holes in the said support arm with the first and second holes in the said side supports; inserting a bolt through the first set of aligned holes; inserting an adjustable pin having a hole therein through the second set of aligned holes; holding said bolt in place by screwing a nut on said bolt; and holding said adjustable pin in place by inserting a cotter pin through said hole in said adjustable pin.

3. An ankle and foot exercise apparatus as described by claim 2, wherein the said elastic member is maintained in an unstressed condition during attachment and removal of the said exercise apparatus by removing said adjustable pin from engagement with said support arm and said side supports, and pivoting said support arm downward on said bolt.

4. An ankle and foot exercise apparatus as described by claims 1 or 2 or 3, wherein the said elastic member has substantially the elastic properties of a surgical hose.

* * * * *